United States Patent [19]

Neppel

[11] 4,253,355

[45] Mar. 3, 1981

[54] VALVE BOX ADJUSTING TOOL

[76] Inventor: Gerald J. Neppel, 1615 River Rd., East Grand Forks, Minn.

[21] Appl. No.: 39,637

[22] Filed: May 16, 1979

[51] Int. Cl.[3] ..... B25B 13/16

[52] U.S. Cl. ..... 81/167

[58] Field of Search ..... 81/53 R, 72, 155, 165–167, 81/177 A; 269/106, 142, 145, 155

[56] References Cited

U.S. PATENT DOCUMENTS

| | | | |
|---|---|---|---|
| 2,366 | 11/1841 | Hogle . | |
| 490,519 | 1/1893 | Wayland | 269/145 |
| 604,160 | 5/1898 | Reissmann | 269/145 X |
| 1,357,518 | 11/1920 | Ruff . | |
| 2,549,910 | 4/1951 | Lane | 81/177 A UX |
| 2,743,641 | 5/1956 | Stricklett et al. | 81/165 X |
| 3,094,022 | 6/1963 | Young | 81/53 R X |
| 3,458,183 | 7/1969 | Rescigno | 81/72 X |

*Primary Examiner*—James G. Smith

*Attorney, Agent, or Firm*—Burd, Bartz & Gutenkauf

[57] ABSTRACT

A tool having a gripping mechanism engageable with separate parts of the upper end of a valve box assembly to transfer rotational force to the box assembly to adjust the height thereof. The tool has an upright body connected to a cross handle at its upper end and the gripping mechanism at its lower end. The gripping mechanism has a plurality of adjustable heads located along cord lines with respect to the axis of rotation of the tool. Each head has an edge which moves into driving contact with a separate part of the box assembly when the gripping mechanism is rotated.

18 Claims, 7 Drawing Figures

FIG. 4
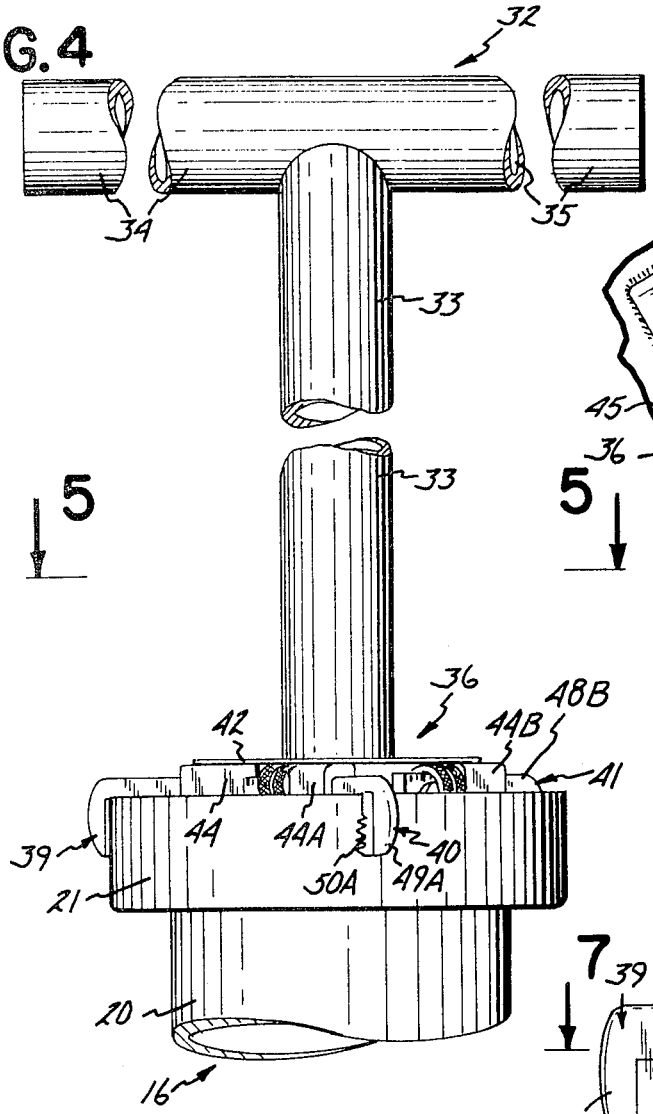
FIG. 7
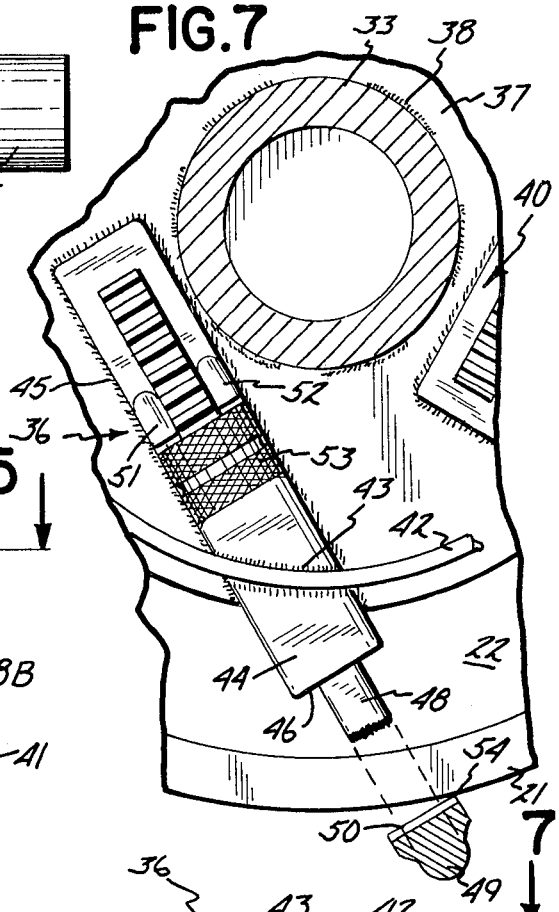
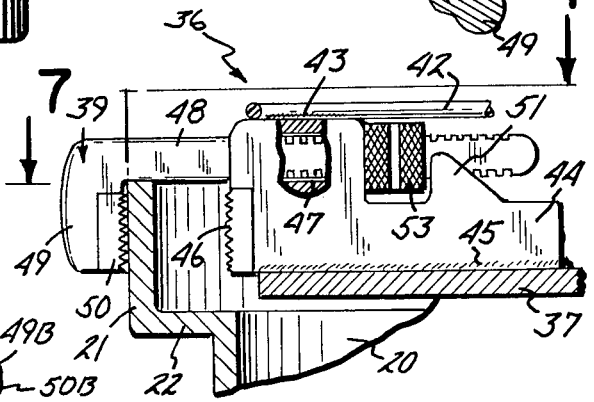
FIG. 6
FIG. 5
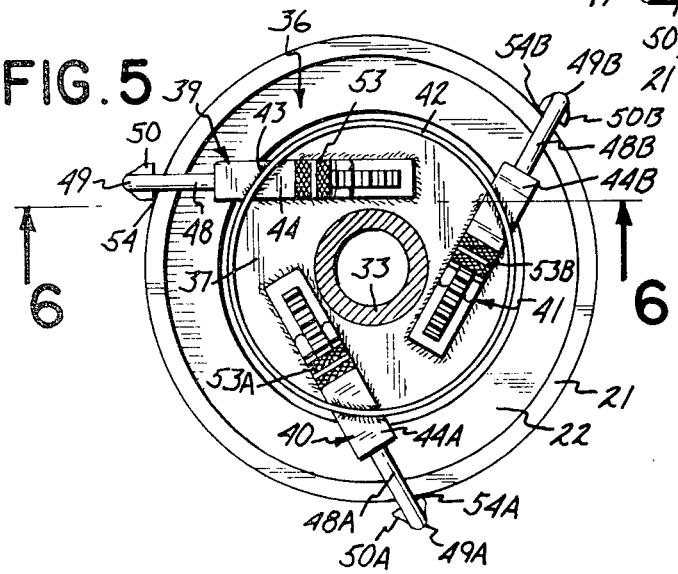

VALVE BOX ADJUSTING TOOL

SUMMARY OF INVENTION

The invention is directed to an apparatus for adjusting the length of a two or more piece valve box assembly used to provide access to a valve unit buried in the ground. A conventional valve box assembly is adjustable in length to position the top of the assembly flush with the ground line. The apparatus is a turning tool having a gripping mechanism adapted to grip separate portions of the upper end of the valve box assembly so that rotational force can be applied to the valve box assembly to adjust its height. The gripping mechanism is connected to an upright body carrying a crossbar or handle. Rotational force is applied to the handle to rotate the turning tool. The gripping mechanism includes a plurality of adjustable grip means. Each grip means is located along a cord line with respect to the axis of rotation of the tool. The grip means each have an adjusting sleeve that functions to adjust the position of a head and hold the head in engagement with the side wall of the valve box assembly. The grip means are adjustable to accommodate different sizes of valve box assemblies and concurrently function to place substantially equal pressure at separate sections of the upper end of the valve box assembly and thereby minimize breakage and damage to the valve box assembly. The turning tool is used by removing only a minimum amount of soil and turf from adjacent the upper end of the valve box assembly. The turning tool is an integral structure with no loose parts that is economical and sturdy in construction.

IN THE DRAWINGS

FIG. 4 is a foreshortened side elevational view of the valve box adjusting apparatus of the invention;

FIG. 5 is a sectional view taken along the line 5—5 of FIG. 4;

FIG. 6 is an enlarged sectional view taken along the line 6—6 of FIG. 5; and FIG. 7 is a sectional view taken along the line 7—7 of FIG. 6.

DESCRIPTION OF PREFERRED EMBODIMENT

Figure 1:
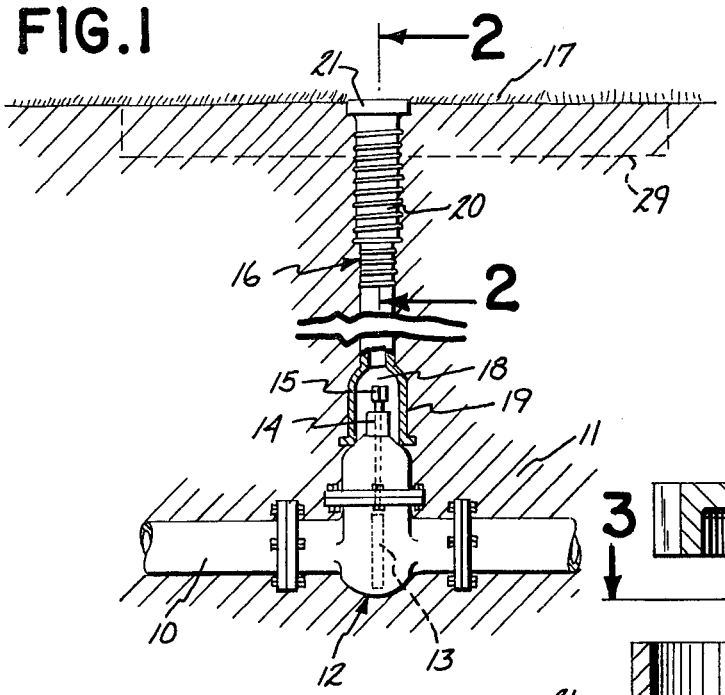
FIG. 1 is a foreshortened side elevational view of a valve unit in a buried water main associated with an adjustable valve box assembly.

Referring to FIG. 1, there is shown a generally horizontal water pipe or main 10 located in the ground 11. It is common practice to locate water pipe under ground below the frost line. Main 10 is connected to a valve unit indicated generally at 12 operable to close the line. Valve unit 12 has a movable valving member or discs 13 operably connected to a control 14. Control 14 includes a threaded member having a square head 15. Head 15 can have other non-circular shapes to accommodate a tool used to rotate control 14 thereby regulating the open and closed positions of valving member 13 to control the flow of water in main 10.

Figure 2:
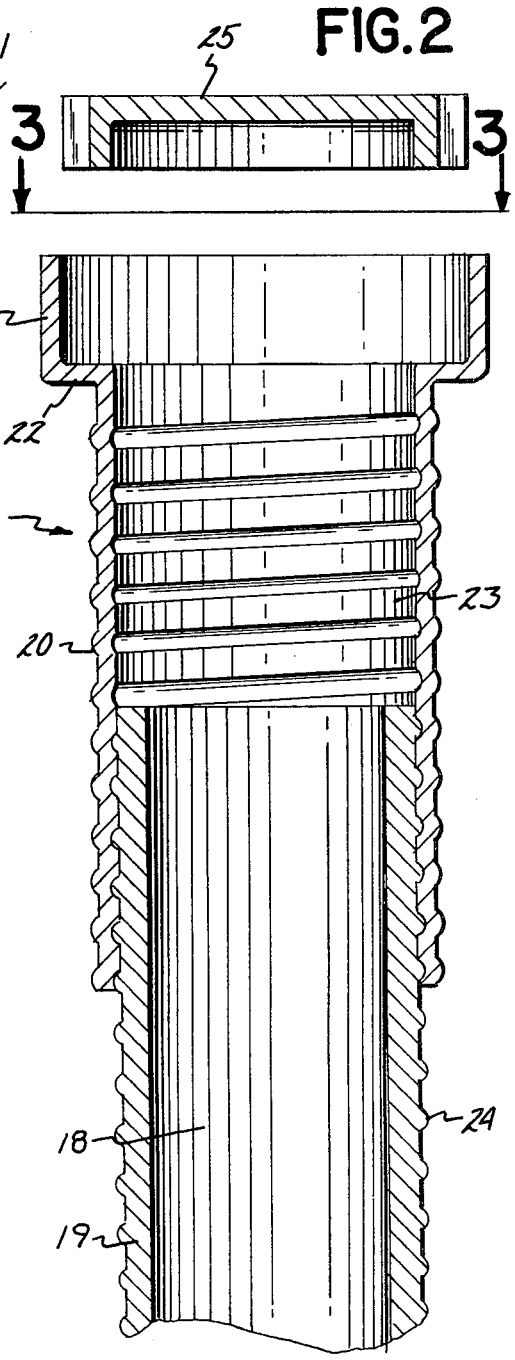
FIG. 2 is an enlarged sectional view taken along the line 2—2 of FIG. 1 with the cap elevated above the top of the valve box assembly.

An adjustable valve box assembly indicated generally at 16 is positioned on top of valve unit 12 and extends upwardly to ground surface 17. Valve box assembly 16 is a two part tubular structure having an upright passage 18 leading from control 14 to the ground surface 17. Valve box assembly 16 comprises a lower tubular member 19 having an enlarged bell-shaped lower end that surrounds control 14 and rests on top of the stuffing box of valve unit 12. A second or upper tubular member 20 is threaded on the upper end of the lower member 19. As shown in FIG. 2, upper member 20 has an enlarged upright annular side wall or flange 21 joined to an annular inwardly directed shoulder 22. Threads 23 on member 20 and threads 24 on member 19 cooperate with each other to provide for a selected longitudinal length of the valve box assembly 16. The upper member 20 is rotated relative to lower member 19 to change the overall length of valve box assembly 16. A cap fits into the chamber surrounded by side wall 21 to close the top of passage 18. Valve box assembly 16 is a conventional structure used to provide access to the underground valve unit 12 in water main 10. Valve box assembly 16 is available in a range of lengths. Extensions from 60 to 215 cm or more can be used with members 19 and 20 to increase the length thereof. Members 19 and 20 can be cast iron pipes having an inside diameter of 15 cm. Other materials and structural sizes can be used to make valve box assembly 16.

In use, the adjustable valve box assembly 16 is used to provide for changes in the ground line above water main 10. When water mains are placed under ground, there is ground settlement which results in the upper end of the valve box assembly to project above the ground line. The frost conditions can heave or elevate the ground whereby the upper end of the valve box assembly is located below the ground line. Soil erosion and water run off also removes soil from the ground line adjacent the upper end of valve box assembly 16. It is customary to have the upper end of the valve box assembly 16 flush or even with ground line 17 so that the utility personnel can locate the cap 25 and use a socket-type tool to rotate control 14 thereby controlling the flow of water in main 10.

Figure 3:
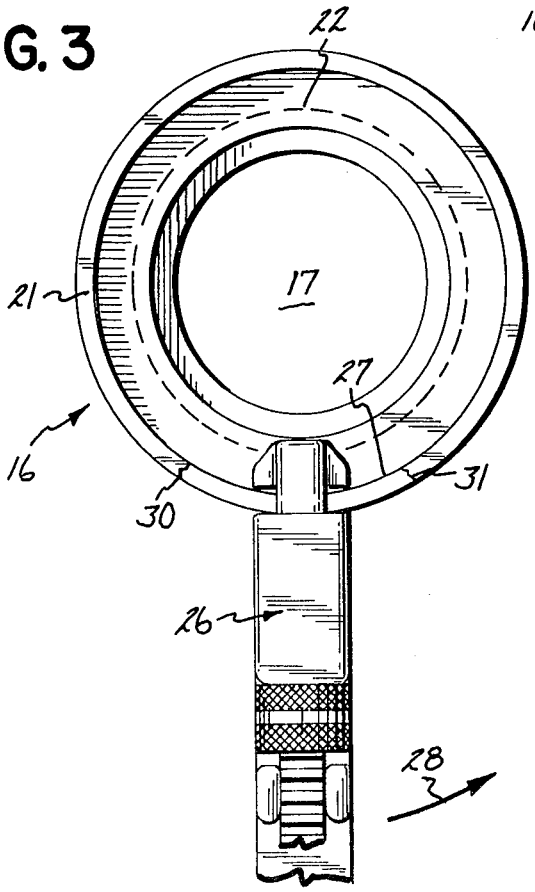
FIG. 3 is an enlarged sectional view taken along the line 3—3 in FIG. 2 in the direction of the arrows.

It has been a prior practice to use a relatively large wrench, such as a pipe wrench 26, as shown in FIG. 2, to rotate the upper member 20 relative to the lower member 19 and thereby regulate the length of valve box assembly 16 and position the upper end thereof relative to ground line 17. Pipe wrench 26 is positioned over a portion of the annular side wall 21 to grip member 20. This requires that a substantial amount of sod and soil be removed from adjacent the upper end of valve box assembly 16. As shown in FIG. 1, a broken line 29 indicates the amount of soil and sod that is normally removed to permit rotation of member 20 with the conventional pipe wrench 26. As shown in FIG. 3, the pipe wrench's jaw and lip are placed adjacent opposite sides of a portion 27 of side wall 22. The pipe wrench 26 extends radially therefrom to provide a torque arm for rotating member 20. When force in the direction of arrow 28 is applied to the pipe wrench 26, large forces are placed on the wall segment 27. These forces are concentrated on a relatively small part or segment 27 of side wall 21 so that when torque is applied to pipe wrench 26 segment 27 breaks out of side wall 21, as indicated by the break lines 30 and 31. When a valve box assembly is broken, it is replaced. This requires extensive excavation, time and expense.

Referring to FIGS. 4 to 6, there is shown the apparatus or turning tool indicated generally at 32 for adjusting the length of valve box assembly 15. This is accomplished with removal of a minimum of soil and sod adjacent flange 21. Apparatus 32 extends vertically above the upper tubular member 20 and grips a plurality of spaced separate portions of side wall 21. Apparatus 32 has an upwardly directed tubular body 33 joined at its upper end to a cross bar or tubular handle 34. Handle 34 has a horizontal passage for accommodating a rod or circular bar used to extend the torque arm of handle 35. The bar can project from either end of handle 35 or both ends of handle 35 so that a plurality of workmen can conveniently rotate body 32 about a generally vertical axis.

A gripping mechanism indicated generally at 36 is attached to the lower end of body 32. Gripping mechanism 36 engages a plurality of separate and circumferentially spaced portions of side wall 21 to equalize the rotational forces that are applied to the side wall 21. Gripping mechanism 36 includes a disc or plate 37 secured by welds 38 to lower end of body 33. A plurality of engaging means indicated generally at 39, 40 and 41 are attached by welds to the top of plate 37. As shown in FIG. 5, gripping means 39, 40 and 41 are located along the sides of an equilateral triangle positioned concentrically about the longitudinal axis of body 33. Each gripping means 39, 40 and 41 extends along a cord line with respect to the circular disc or plate 37. Intersecting cord lines of gripping means 39, 40 and 41 are at an acute angle. A ring 42 is attached by welds to each of the gripping means 30, 40 and 41. Ring 42 and plate 37 hold gripping means 39, 40 and 41 in fixed positions relative to each other. Gripping means 39, 40 and 41 are identical in structure. The following detailed description is directed to gripping means 39. The parts of gripping means 40 and 41 that correspond to the parts of gripping means 39 have the same reference numbers with the suffix A and B respectively.

Referring to FIG. 6, gripping means 39 has a base or body 44 having a bottom edge located on top of plate 37. Weld 45 secures body 44 to plate 37. Other types of fastening means, as nut and bolt assemblies, can be used to connect body 44 to plate 37. Body 44 has a first jaw 46 located at its outer end facing the inside of side wall 21. Body 44 has a hole or passage 47 accommodating a shank or neck 48. The outer end of neck 48 has downwardly directed head 49. A second or outer jaw 50 is integral with the inside of head 49. Jaw 50 has teeth that face the outside of side wall 21. As shown in FIG. 7, jaw 50 extends at an angle that converges toward and intersects the outside surface of side wall 21. Jaw 50 has a forward edge 54 that bites or digs into side wall 21 when rotational force is applied to cross bar 34. Edge 54 includes the forward ends of corners of the teeth on jaw 50. The teeth corners are relatively sharp to enhance the grip of jaw 50 on side wall 21.

Body 44 has a pair of upwardly directed ears 51 and 52 located on opposite sides of the inner portion of neck 48. A rotatable sleeve 53 threaded on neck 48 is located between ears 51 and 52 and the body 44. Sleeve 53 is rotatable to adjust the position of neck 48 and head 49 relative to body 44. Sleeve 53 is rotated to move head 49 toward side wall 21 and hold edge 54 of the head 49 in engagement with side wall 21.

An example of apparatus or turning tool 32 used to adjust height of a valve box assembly having a top side wall 21 with a 15 cm diameter is as follows. Body 33 is an upright tube having a length of about 1 meter. Cross bar 34 is a tubular member having a length of about ½ meter. The center of the cross bar is secured by welds or the like to the upper end body 33. Plate 37 is a steel disc having a diameter of 12 centimeters secured by a weld to the lower end body 33. The gripping means 39, 40 and 41 are 12 inch or 30 cm pipe wrenches. Each wrench has a handle or base 44 that is secured by welds 45 to the top of plate 37. The first or inner jaws 46, 46A and 46B of each pipe wrench is located about 1 cm outwardly from the outer peripheral edge of plate 37. The outer jaws 50, 50A and 50B each have a plurality of transverse grooves forming teeth that face side wall 21. The teeth terminate in forward edges 54, 54A and 54B that function to dig into side wall 21 when turning tool 32 is rotated in a counterclockwise direction shown in FIG. 5. The specific example is not intended to limit the size nor structure of the components of turning tool 32. Other structures, materials, and sizes and shape of structure can be used in turning tool 32.

In use, to change the length of valve box assembly 16 a small amount of soil and sod is removed from around the side wall 21. Cap 25 is removed from valve box assembly 16 exposing passage 18. Turning tool 32 is located in an upright position over the top of side wall 21. As shown in FIG. 6, plate 37 fits into the upper end of passage 18 surrounded by side wall 21. The heads 49, 49A and 49B extend over and are located adjacent the outside surface of side wall 21. The workmen move the heads 49, 49A and 49B toward the side wall 21 by rotating the sleeves 53, 53A and 53B. Sleeves 53, 53A and 53B threaded on necks 48, 48A and 48B move the heads inwardly until the side edges 54, 54A and 54B are in engagement with the outside of sidewall 21. The sleeves 53, 53A and 53B are adjustable to accommodate the different sized side walls 21 and variations in the structure of side walls 21.

Turning tool 32 is rotated in a counterclockwise direction, as viewed in FIG. 5, to lengthen the valve box assembly 16. The corners 54, 54A and 54B dig into the side wall 21. As shown in FIG. 5, the corners 54, 54A and 54B are circumferentially spaced from each other and engage separate sections of side wall 21. The sections are about 120° apart. Substantially equal pressures or forces are applied to separate sections of side wall 21. This minimizes the breakage or damage to side wall 21 during the turning of the member 20 by turning tool 32. The tooling tool 32 is used without disturbing any appreciable amount of soil and turf from adjacent the upper end of valve box assembly. The turning tool 32 is a sturdy and economical structure that has no loose or separable parts. The turning tool 32 can be used with a single workman to adjust the elevations of valve box assembly 16. This can be done with a minimum of time and labor.

While there has been shown and described a preferred embodiment of the turning tool of the invention, it is understood that changes in structures, size and materials of the structure and arrangement of the structure can be made without departing from the invention. The invention is defined in the following claims.

I claim:

1. An apparatus for rotating a member having a wall comprising: body means attached to be rotated about an axis, and a grip mechanism secured to the body means attached to engage a plurality of separate sections of said wall to couple the apparatus to the member whereby rotation of the body means rotates the member, said gripping means including a plurality of grip means for engaging separate sections of said wall, each grip means includes a head engageable with said wall, a body having a passage, a neck extended through said passage, said neck being connected to said head, a sleeve threaded onto the neck engageable with the body to locate the head relative to the body, said sleeve being rotatable to move the head relative to the body and into engagement with said side wall, and means connecting each grip means to the body means.

2. The apparatus of claim 1 wherein: said body and neck are located along a line off-center relative to the axis of rotation of the body means.

3. The apparatus of claim 2 wherein: each head has an edge adapted to bite into said wall upon rotation of the body means in one direction.

4. The apparatus of claim 3 wherein: said edge has a plurality of teeth.

5. The apparatus of claim 1 wherein: three grip means are connected to the means connecting the grip means to the body means, said three grip means being located along the sides of a triangle disposed about the axis of rotation of the body means.

6. The apparatus of claim 5 wherein: each head has an edge adapted to bite into said wall upon rotation of the body means in one direction.

7. The apparatus of claim 1 wherein: the member is a valve box assembly having a tubular member having an annular side wall, said head of each of said grip means having a jaw engagable with a section of the outside of said side wall.

8. The apparatus of claim 7 wherein: each jaw has an edge adapted to bite into said side wall.

9. The apparatus of claim 1 wherein: said body and neck are located along a line off-center relative to the axis of rotation of the body means.

10. The apparatus of claim 1 wherein: the member is a valve box assembly having a tubular member having an annular side wall, said head of each grip means having a jaw engageable with a section of the outside of said side wall, said grip means comprising three grip means connected to the means connecting the grip means to the body means, said three grip means being located along the sides of a triangle disposed about the axis of rotation of the body means.

11. The apparatus of claim 10 wherein: each jaw has an edge adapted to bite into said side wall.

12. A tool for adjusting a valve box assembly having an upper member with a generally cylindrical top flange, said upper member being rotatable about an axis to adjust the elevation thereof comprising: body means adapted to be rotated about the axis of the member, and a gripping mechanism attached to the body means adapted to contact a plurality of circumferentially spaced sections of the flange whereby on rotation of the body means about said axis the gripping means rotates said upper member to adjust the elevation thereof, said gripping mechanism including first means connected to the body means, and a plurality of second means connected to the first means for rotation therewith, said second means having means movable into driving engagement with the flange, said second means comprising a plurality of grip means, each grip means having a body having a passage, a neck extended through said passage, head means connected to said neck, a sleeve threaded onto the neck engageable with the body to rotate the head means relative to the body, said sleeve means being rotatable to move the head means relative to the body.

13. The tool of claim 12 wherein: the body means is a generally linear member and handle means secured to the member to facilitate rotation thereof.

14. The tool of claim 13 wherein: the handle means is a tubular member located generally transverse to the axis of the linear member, said tubular member having a passage for accommodating means to increase the torque arm of the handle.

15. The tool of claim 12 wherein: the first means includes a transverse plate secured to the body means each of, said grip means being secured to said plate.

16. The tool of claim 12 wherein: each head means has edge means adapted to engage said flange.

17. The tool of claim 12 wherein: said body and neck are located along a line off-center relative to the axis of rotation of the axis of the member.

18. The tool of claim 12 wherein: said second means comprises three grip means, said three grip means being located along the sides of the triangle disposed about the axis of rotation of the body means.

* * * * *

UNITED STATES PATENT AND TRADEMARK OFFICE

CERTIFICATE OF CORRECTION

PATENT NO. : 4,253,355

DATED : March 31, 1981

INVENTOR(S) : Gerald J. Neppel

It is certified that error appears in the above-identified patent and that said Letters Patent are hereby corrected as shown below:

Column 3, line 30, "30" should be --39--.

Signed and Sealed this

Fourth Day of August 1981

[SEAL]

*Attest:*

GERALD J. MOSSINGHOFF

*Attesting Officer*

*Commissioner of Patents and Trademarks*